United States Patent [19]

Tognazzini et al.

[11] 4,160,889

[45] Jul. 10, 1979

[54] ELECTRICAL TERMINAL BLOCK

[76] Inventors: Jere W. Tognazzini, 7301 Lakewood Blvd., Dallas, Tex. 75214; Kenneth R. Humphreys, 5737 McComas, Apt. 208, Dallas, Tex. 75206

[21] Appl. No.: 860,683

[22] Filed: Dec. 15, 1977

[51] Int. Cl.[2] ..... H01H 1/38; H01H 1/42

[52] U.S. Cl. ..... 200/163

[58] Field of Search ..... 200/163, 162, 165, 153 A, 200/153 D

[56] References Cited

U.S. PATENT DOCUMENTS

| | | | |
|---|---|---|---|
| 1,836,951 | 12/1931 | Blakeslee | 200/163 |
| 1,891,212 | 12/1932 | Blakeslee | 200/163 |
| 2,249,977 | 7/1941 | Penfold | 200/163 |
| 2,271,588 | 2/1942 | Hecht et al. | 200/163 |

FOREIGN PATENT DOCUMENTS

| | | | |
|---|---|---|---|
| 555374 | 1/1957 | Italy | 200/163 |

*Primary Examiner*—William Price
*Assistant Examiner*—Joseph Man-Fu Moy
*Attorney, Agent, or Firm*—Thomas L. Cantrell; Joseph H. Schley

[57] ABSTRACT

Disclosed is an improved electrical terminal block having an insulative base with a pair of parallel fixed links mounted thereon by staked connector posts of improved configuration. A movable link is slidingly mounted on one link and engageable with the other to establish a current path from one post to the other. The movable link has a lock screw for locking the link in connected or disconnected position. The base of the block has sidewalls which surround at least a portion of the slidable link throughout its path of travel. The slidable link is proportioned and configured with respect to the block and fixed links so that it is in a mechanically secure and stable condition in both the connected and disconnected positions.

7 Claims, 9 Drawing Figures

FIG. 1
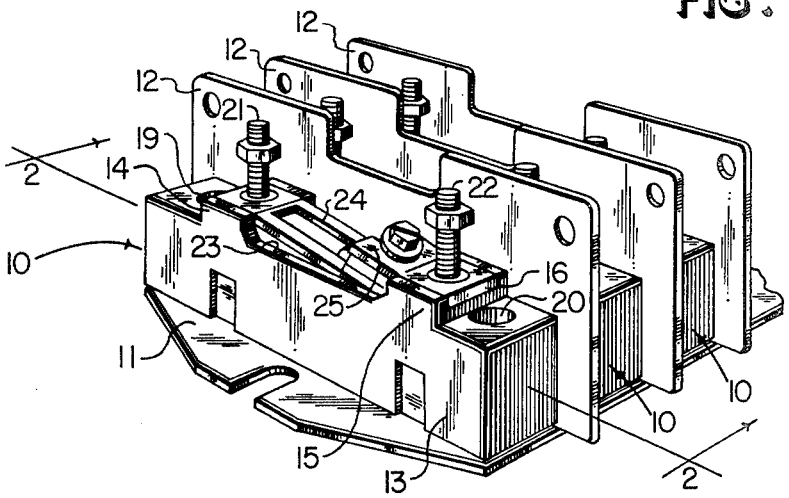
FIG. 2
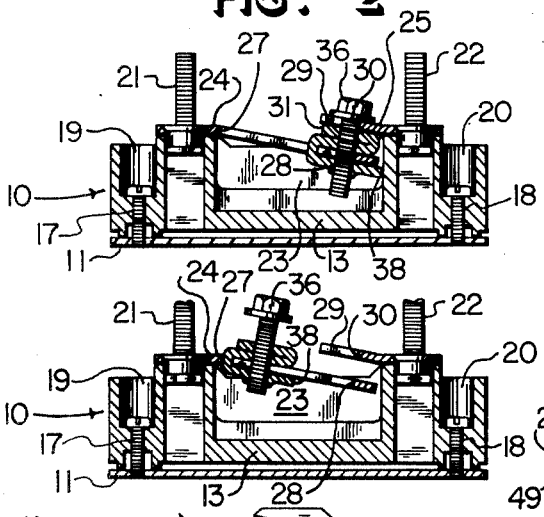
FIG. 3
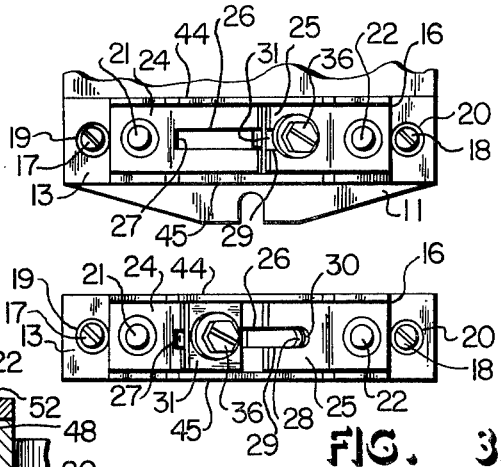
FIG. 3A
FIG. 2A
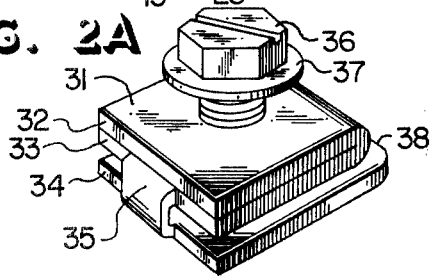
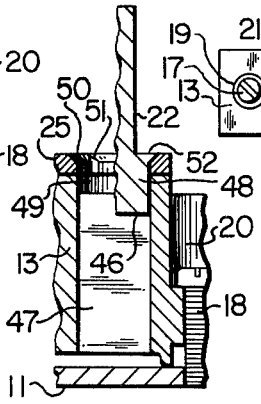
FIG. 7
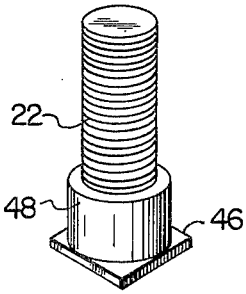
FIG. 5
FIG. 4
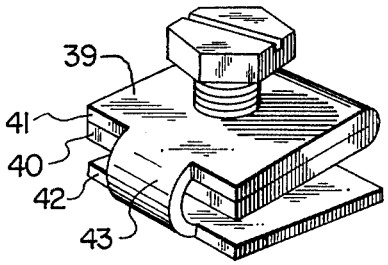
FIG. 6 (PRIOR ART)

ELECTRICAL TERMINAL BLOCK

BACKGROUND OF THE INVENTION

Electrical terminal blocks of the general kind to which this invention relates are quite commonly used in electric power plant and substation control circuits in considerable numbers. Their primary function is to permit interruption of the circuits, or a single circuit, for the temporary insertion of artificial loads or test equipment without disturbing the permanent wiring in the circuit. Among the performance requirements of terminal blocks are durability, since they are components of long-lived circuit construction; strength, especially during circuit opening and closing operations; safety during opening and closing; and positiveness of actuation.

Terminal blocks of the class to which the invention relates are shown in Blakeslee U.S. Pat. Nos. 1,836,951 (1931) and 1,891,212 (1932), and the structure of such terminal blocks has changed but little since then. Most more recent changes have been in the direction of reducing manufacturing costs, and not all of these have resulted in devices as satisfactory as Blakeslee's from an operational and safety standpoint.

SUMMARY OF THE INVENTION

In accordance with the present invention an improved terminal block is provided which comprises an insulative base of generally rectangular configuration having an upstanding electrically conductive connector post mounted adjacent each end thereof. Provision is made for mounting the blocks to a surface by screws. To each connector post is staked a fixed electrically conductive link, the staking of the post and link serving also to secure these parts to the insulative body. The fixed links extend toward each other in parallel planes, which planes are preferably slightly inclined with respect to the horizontal. One fixed link is relatively long, and extends over a substantial portion of the distance between the connector posts. The other fixed link is relatively short, and extends somewhat less than one half the distance between the posts. The long fixed link has a closed-ended slot therein, with the end of the slot remote from the short link being rounded. The short fixed link has an open-ended slot formed therein which faces toward the long fixed link, with the end of the slot being rounded and aligned with the round end of the slot in the long link.

The movable link comprises a unitary stack of three layers of conductive metal. Two layers of the link are arranged to lie above the upper surface of the long fixed link and to fit under the lower surface of the short fixed link. The third layer is arranged to lie below the lower surface of the long fixed link. It is connected to the lower layer of the upper pair by a tab which is proportioned to fit through the slot in the long fixed link. The tab has a substantially flat outer surface which abuts the squared-off end of the slot in the long link when the movable link is in the disconnected position. The bottom most layer of the movable link is longer than the other two layers so that it will abut a surface of the insulative base when the movable link is in the connected position.

A locking screw passes through all three layers of the movable link, and through the slot in the long fixed link. It is so positioned that it abuts the rounded ends of the slots in both fixed links when the movable link is in the connected position. Preferably the end of the locking screw is staked so that it cannot be separated from the movable link.

The insulative base is provided with sidewalls which extend upwardly between the connector posts to define, with the ends of the base, a rectangular upwardly open compartment in the central portion of the base. The sidewalls extend upwardly sufficiently far so that they surround at least a portion of the movable link throughout its path of travel between the connected and disconnected positions.

The connector posts have square heads with cylindrical shoulders adapted to be staked in chamfered holes in the fixed links. The square heads work in square bores in the insulative base. The staking operation unites the base, posts and fixed links into a strong, secure structure.

From the foregoing, it can be seen that the principal object of this invention is the provision of an improved electrical terminal block which is safe in operation, mechanically positive and secure in actuation, and economical in construction.

The manner in which this object and other objects are attained may best be understood by a consideration of the detailed description which follows, together with the accompanying drawings.

DESCRIPTION OF THE DRAWINGS

FIG. 1 is a perspective view of several electrical terminal blocks of the invention mounted side-by-side on a typical mounting plate;

FIG. 2 is a side cross sectional elevational view of a terminal block of FIG. 1, the section being taken on the line 2—2 of FIG. 1 and showing the device in its connected position;

FIG. 2A is a view similar to FIG. 2 showing the device in its disconnected position;

FIG. 3 is a plan view of a terminal block and a fragment of a mounting plate showing the device in its connected position;

FIG. 3A is a view similar to FIG. 3 (with the mounting plate omitted) showing the device in its disconnected position;

FIG. 4 is a perspective view on an enlarged scale as compared to FIGS. 1–3A, of a movable link constructed in accordance with the invention;

FIG. 5 is a perspective view on an enlarged scale as compared to FIGS. 1–3A, of a connector post in accordance with the invention;

FIG. 6 is a perspective view on an enlarged scale as compared to FIGS. 1–3A, of a movable link of the prior art; and FIG. 7 is a fragmentary sectional elevational view on an enlarged scale as compared to FIGS. 1–3A of a portion of a connector post, fixed link, and the base, showing the mode of staking these parts together.

DESCRIPTION OF THE PREFERRED EMBODIMENT

In the drawings, the electrical terminal block of the invention is designed generally as 10. A gang of three such blocks is shown in FIG. 1 mounted on mounting strip 11 and separated by insulative cards 12. Neither the mounting strips nor the cards form part of the invention, and they are illustrated merely to show a typical environment or setting for the invention.

The terminal block 10 includes a generally prismatic insulative base 13, which has raised bosses 14, 15 on its upper surface. The bosses are longitudinally grooved, as at 16, to provide mounting means for the fixed links of the terminal block discussed below. Near each end of base 13, means for mounting the block 10 on strip 11 are provided in the form of screws 17, 18, in deep bores 19, 20 in the base. In this way, good electrical insulation of the mounting means is provided.

Terminal block 10 has mounted upon it a pair of upstanding connector posts 21, 22. Between the posts an upwardly open compartment or cavity 23 is formed in base 13. Associated with post 21 is long fixed link 24, and associated with post 22 is short fixed link 25. Long link 24 extends toward post 22 a substantial portion of the distance between the two posts, and is angled downwardly into cavity 23. Short link 25 extends toward post 21 for somewhat less than half the distance between the two posts, and is angled upwardly, away from cavity 23. The portions of links 24 and 25 which are located in or above cavity 23 are thus positioned in parallel planes.

The long link 24 has a closed-ended slot 26 formed therein. Slot 26 runs axially of the link. The end of the slot remote from short link 25 is squared-off, as at 27; and the end of the slot adjacent short link 25 is rounded, as at 28. Short link 25 is provided with an open ended slot 29 lying in the same vertical plane as slot 26 in the long link. The open-ended slot 29 is rounded at its closed end, as at 30, and the rounded ends 28, 30, of the two slots are aligned.

Mounted for sliding movement on long link 24 is movable link 31, which appears on an enlarged scale in FIG. 4. Link 31 comprises a unitary stack of three generally rectangular flat layers of metal designated, from top to bottom 32, 33, and 34. The upper two layers 32 and 33 lie closely adjacent each other, and their combined thickness is substantially equal to the distance between the lower side of short link 25 and the upper side of long link 26. Preferably layers 32 and 33 are formed by folding layer 32 back over layer 33, as appears in FIG. 4. Bottom layer 34 is spaced from layers 32 and 33 by a distance substantially equal to the thickness of long link 24. Layer 34 is connected with layer 33 by tab 35, which is slightly narrower than the width of slot 26. The outer surface of tab 35 is substantially flat so that it may cleanly abut square end 27 of slot 24.

The movable link 31 is mounted on long link 24 with layers 32 and 33 lying above the upper surface of link 24 and layer 34 lying below the lower surface of link 24, with tab 35 extending through slot 26 in the long link. A locking screw 36, preferably with an integral washer 37, passes through all three layers and through slot 26. It is preferably staked so that it cannot be removed from link 31.

It should be noted that bottom layer 34 of link 31 is longer than upper layers 32 and 33, as is indicated at 38. This construction assures that the edge 38 of layer 34 will abut or seat against the end wall of cavity 23 when screw 36 abuts against rounded slot ends 28 and 30 in the connected position of link 31.

Movable link 31 should be contrasted with prior art movable link 39 shown in FIG. 7. That link has its middle layer 40 folded under top layer 41, instead of the top layer being folded back upon the middle layer, and top layer 41 is connected with bottom layer 42 by curved tab 43, instead of connecting the middle layer with the bottom layer by a straight tab. Layer 42 has the same length as the other layers, and hence will not seat against the base in the connected position. Furthermore, curved tab 43 will not seat as positively against the end of slot 26 in the disconnected position. In addition, in the construction of FIG. 7, it is difficult to manufacture the piece so that all layers are parallel.

Cavity 23 in base 13 has sidewalls 44, 45 which extend upwardly sufficiently far that they surround at least a portion of movable link 31 at all times, even when it is in the disconnected position.

From the foregoing description it can be seen that the terminal block of the invention is secure and positive in its actuation from one rest position to another. There is no danger that link 31 will become separated from the balance of the apparatus. In both the connected and disconnected positions link 31 is seated positively against portions of the fixed links and is engaged by the sidewalls of the base.

As can be seen from FIGS. 5 and 7 stud 22 has a square head 46 which seats in square bore 47 of base 13. The stud has a cylindrical shoulder 48 which fits through a circular bore 49 in base 13 and chamfered hole 50 in link 25. The chamfered portion of hole 51 has several serrations 51 formed therein. When shoulder 48 is staked as shown at 52 in FIG. 7, a portion of the metal flows into the chamfer and into its serrations, thus uniting the base, link, and stud into a very strong and rugged structure. Post 21 and link 24 are mounted on base 13 in the same way.

We claim:

1. In an electrical terminal block of the kind having an insulative base; a pair of spaced posts on said base; a pair of parallel fixed links connected to said posts and extending toward each other, one of said fixed links being relatively long, and the other being relatively short; and a movable link slidingly mounted on said long link for movement between a connected position in which it engages both fixed links, and a disconnected position in which it engages only said one link; the improvement which comprises:

said one link being formed of flat electrically conductive material and having an elongated closed-ended slot formed therein axially of the link, the end of said slot adjacent its associated post being squared off, and the other end of said slot being rounded;

said other link being formed of flat electrically conductive material and having a slot therein, the end of said slot adjacent its associated post being rounded and aligned with the rounded end of the slot of said first link, and the other end of said slot being open;

said movable link being formed of three layers of electrically conductive material, two of said layers being proportioned and arranged to lie on top of said one link and fit under said other link in the connected position and the third of said layers being proportioned and arranged to lie under said one layer and being connected to one of said first layers by a substantially flat tab passing through the slot in said one link;

said movable link being provided with a locking screw passing through all three layers of the movable link, through the slot in said one link, and, when the movable link is in the connected position, through the slot in said other link;

said parts being proportioned so that when said movable link is in the connected position said locking screw is abutted against the aligned rounded ends of said slots and the third layer of said movable link is abutted against a surface of said insulative base, and when said movable link is in the disconnected position, said substantially flat tab is abutted against the squared-off end of the slot in said one link.

2. An electrical terminal block in accordance with claim 1 in which said substantially flat tab connects the bottom layer of said movable link with the next upwardly adjacent layer of said link.

3. An electrical terminal block in accordance with claim 1 and further comprising:

a cavity in said insulative base between said posts, the end wall of said cavity adjacent said other link comprising the surface against which the third layer of said movable link abuts in the connected position.

4. An electrical terminal block in accordance with claim 3 in which said cavity is upwardly open and is provided with sidewalls of sufficient height to engage said movable link in both the connected and disconnected positions.

5. An electrical terminal block in accordance with claim 1 in which:

said one link and said other link are each provided with chamfered bores;

in which said insulative base is provided with rectangular bores for mounting said posts;

in which said posts have rectangular heads and cylindrical shoulders thereon; and in which said shoulders are staked to flow into the chamfered bores on said links.

6. An electrical terminal block in accordance with claim 5 in which said chamfered bores are provided with at least one serration.

7. An electrical terminal block in accordance with claim 1 in which said three layer movable link comprises:

a top layer having an edge oriented toward the post associated with the long fixed link;

a fold oriented toward the post associated with the short fixed link connecting said top and middle layers;

a middle layer lying snugly under said top layer;

a tab having a substantially flat outer surface oriented toward the post associated with the long fixed link connecting said bottom and middle layers; and a bottom layer having an edge oriented toward the post associated with the short fixed link, said bottom layer having a length greater than said middle and top layers.

* * * * *